US008944292B2

(12) United States Patent
Moreau

(10) Patent No.: US 8,944,292 B2
(45) Date of Patent: Feb. 3, 2015

(54) DISPENSER OF FLUID MATERIAL

(75) Inventor: Francis Moreau, Sotteville les Rouen (FR)

(73) Assignee: Aptar France SAS, Le Neubourg (FR)

( * ) Notice: Subject to any disclaimer, the term of this patent is extended or adjusted under 35 U.S.C. 154(b) by 0 days.

(21) Appl. No.: 13/510,868

(22) PCT Filed: Nov. 15, 2010

(86) PCT No.: PCT/FR2010/052420

§ 371 (c)(1),
(2), (4) Date: May 18, 2012

(87) PCT Pub. No.: WO2011/061434

PCT Pub. Date: May 26, 2011

(65) Prior Publication Data

US 2012/0223103 A1 Sep. 6, 2012

(30) Foreign Application Priority Data

Nov. 19, 2009 (FR) ..... 09 58176

(51) Int. Cl.
*B05B 11/00* (2006.01)
*B65D 41/32* (2006.01)
*B65D 83/20* (2006.01)

(52) U.S. Cl.
CPC ..... *B05B 11/3049* (2013.01); *B05B 11/3047* (2013.01); *B65D 83/205* (2013.01)
USPC ..... 222/153.06; 222/321.9; 215/252; 215/258

(58) Field of Classification Search
CPC ..... B65D 2101/0046; B65D 41/3409; B65D 41/3428; B65D 41/3447
USPC ..... 222/541.6, 321.9, 153.06, 153.1, 321.7; 215/250, 251, 252, 274, 258
See application file for complete search history.

(56) References Cited

U.S. PATENT DOCUMENTS

| | | | | |
|---|---|---|---|---|
| 2,054,012 | A * | 9/1936 | Teller | 215/252 |
| 3,001,657 | A * | 9/1961 | Gamble | 215/252 |
| 4,156,490 | A * | 5/1979 | Peraboni | 215/252 |
| 4,225,050 | A * | 9/1980 | Reinhart | 215/252 |
| 4,458,821 | A * | 7/1984 | Ostrowsky | 215/252 |
| 4,846,361 | A * | 7/1989 | Haffner | 215/252 |

(Continued)

FOREIGN PATENT DOCUMENTS

| | | |
|---|---|---|
| DE | 92 18 298 U1 | 11/1993 |
| EP | 2 135 682 A1 | 12/2009 |

(Continued)

*Primary Examiner* — Paul R Durand
*Assistant Examiner* — Charles P Cheyney
(74) *Attorney, Agent, or Firm* — Sughrue Mion, PLLC

(57) ABSTRACT

A fluid dispenser including, a fluid reservoir with a neck externally threaded and that internally defines an opening that communicates with the inside of the reservoir, the neck forming at least one helical thread; and a dispenser head that is mounted on the neck by a fastener member in engagement both with the threaded neck and with the dispenser member. The fastener member includes a ring, the ring forming: a reception mechanism for receiving the dispenser member; an annular ledge; and a skirt that is in engagement with the threaded neck. The ring includes a rupture mechanism between the ledge and the skirt so as to separate the ledge from the skirt by turning the ring on the threaded neck, in such a manner as to remove the dispenser member from the reservoir.

15 Claims, 4 Drawing Sheets

(56) References Cited

U.S. PATENT DOCUMENTS

| | | | | |
|---|---|---|---|---|
| 4,923,073 | A * | 5/1990 | Wilde | 215/252 |
| 4,936,475 | A * | 6/1990 | Montgomery | 215/252 |
| 4,998,988 | A * | 3/1991 | Zinnbauer | 215/230 |
| 5,562,219 | A * | 10/1996 | de Pous et al. | 215/274 |
| 5,657,889 | A * | 8/1997 | Guglielmini | 215/252 |
| 5,660,288 | A * | 8/1997 | Nyman, Jr. | 215/44 |
| 6,575,339 | B2 * | 6/2003 | Jourdin et al. | 222/321.7 |
| 6,595,395 | B2 * | 7/2003 | Jourdin et al. | 222/321.9 |
| 6,772,893 | B2 * | 8/2004 | Pares Montaner et al. | 215/274 |
| 6,908,013 | B2 * | 6/2005 | Thomson et al. | 222/153.06 |
| 7,451,885 | B2 * | 11/2008 | Nyman et al. | 215/252 |
| 8,522,991 | B2 * | 9/2013 | Skelton et al. | 215/252 |
| 2009/0277930 | A1 * | 11/2009 | Carta | 222/153.01 |
| 2009/0283549 | A1 * | 11/2009 | Beranger | 222/321.7 |
| 2011/0240679 | A1 * | 10/2011 | Langlos | 222/321.7 |

FOREIGN PATENT DOCUMENTS

| | | | |
|---|---|---|---|
| WO | 2009/150351 | A1 | 12/2009 |
| WO | 2010/067031 | A1 | 6/2010 |

* cited by examiner

DISPENSER OF FLUID MATERIAL

CROSS REFERENCE TO RELATED APPLICATION

This application is a National Stage of International Application No. PCT/FR2010/052420 filed Nov. 15, 2010, claiming priority based on French Patent Application No. 09 58176 filed Nov. 19, 2009, the contents of all of which are incorporated herein by reference in their entirety.

The present invention relates to a fluid dispenser comprising: a fluid reservoir provided with a neck that is externally threaded and that internally defines an opening that communicates with the inside of the reservoir. The dispenser further comprises a dispenser head that is mounted on the neck of the reservoir, the head comprising: a dispenser member, such as a pump or a valve; a pusher for actuating the dispenser member; and a fastener member that is in engagement both with the threaded neck of the reservoir and with the dispenser member. Such dispensers are frequently used in the fields of perfumery, cosmetics, or even pharmacy.

In general, the fastener member comprises a rigid skirt that internally forms one or more threads for co-operating with the threaded neck of the reservoir. In order to put the dispenser head into place on the reservoir, it suffices to screw the threaded-skirt fastener member on the threaded neck of the reservoir. Conversely, it suffices to unscrew the skirt from the neck in order to remove the head from the reservoir. Conventionally, screw-tightening is performed in the clockwise direction, and unscrewing in the counter-clockwise direction.

A drawback of the screw-tightening/unscrewing member is that it is impossible for the user to know whether or not the dispenser head has already been removed from the reservoir, such that the user may have doubts as to whether or not the dispenser is being used for the first time.

A drawback of the screw-tightening/unscrewing member is that the user may remove the head from the reservoir so as to recover left-over fluid, or add another fluid, or even fill the reservoir. Consequently, the manufacturer of the dispenser has no control over the future use of the dispenser, and as a result cannot guarantee the authenticity of the fluid contained therein.

These two drawbacks result from the fact that it is possible to unscrew the head from the neck, and then to screw it back onto the neck, without spoiling the dispenser, and without leaving any perceptible traces.

An object of the present invention is to remedy the above-mentioned drawbacks of the prior art by defining a fluid dispenser having a fastener member that cannot be removed from the reservoir without this being visible.

Another object of the present invention is to make it impossible to screw the skirt back onto the reservoir once the dispenser head has been removed from the reservoir.

In order to achieve these objects, the invention proposes a fluid dispenser comprising:

- a fluid reservoir provided with a neck that is externally threaded and that internally defines an opening that communicates with the inside of the reservoir, the neck forming at least one helical thread; and
- a dispenser head that is mounted on the neck of the reservoir, the head comprising: a dispenser member, such as a pump or a valve; a pusher for actuating the dispenser member; and a fastener member that is in engagement both with the threaded neck of the reservoir and with the dispenser member;

the fastener member including a ring, the ring forming: reception means that are suitable for securely receiving the dispenser member; an annular ledge for exerting pressure on the neck; and a skirt that is suitable for coming into engagement with the threaded neck;

the ring including rupture means between the ledge and the skirt so as to separate the ledge from the skirt by turning the ring on the threaded neck, in such a manner as to make it possible to remove the dispenser member from the reservoir.

In other words, when the user seeks to unscrew the ring from the threaded neck, the rupture means are broken, such that it is no longer possible to mount the dispenser head once more on the reservoir. Rupturing the ring thus provides first-use security guaranteeing to the user that the dispenser has not previously been opened.

Advantageously, the dispenser includes abutment means preventing the skirt from being unscrewed from the threaded neck. In a practical embodiment, the neck includes an annular peripheral lip that is situated above the thread, the lip defining the abutment means in the form of an annular shoulder below which the skirt comes into abutment when it is desired to unscrew it from the neck. And according to a particularly ingenious characteristic, the thread of the neck slopes upwards from right to left, such that the screw-tightening direction is counter-clockwise and the unscrewing direction is clockwise. This implies that, in reality, a user trying to unscrew the skirt from the neck, actually screws it on more tightly thereby causing the rupture means to rupture. Thus, without realizing it, the user permanently spoils the fastener ring by separating the skirt from the remainder of the ring. Preferably, the rupture means are formed at the skirt.

Another drawback of the conventional screw-fastener member resides in the fact that it is not always easy to determine how much torque is required to screw the fastener member onto the threaded neck of the reservoir in order to obtain appropriate tightness. Mounting a screw-fastener member thus requires the use of a special mounting machine that generates determined torque.

The present invention also solves this drawback by advantageously making provision for the skirt to be malleable in such a manner as to deform against the threaded neck, such that the ring may be mounted on the threaded neck without screw-fastening it: a mere axial movement suffices. Preferably, the fastener member further includes a rigid hoop that is engaged around the skirt so as to push the skirt radially against the threaded neck in such a manner as to deform the skirt against the thread of the neck and create a thread indentation in the skirt. The fastener member is thus engaged with the thread of the neck by axial, then radial, movement, without any turning component.

Advantageously, the skirt is internally provided with a plurality of beads for being deformed by the thread of the neck. Thus, contact with the thread of the neck is performed only at the beads that are distributed around the neck in discrete manner. The beads are preferably elongate and extend substantially transversally to the thread. The beads may thus be in the form of vertical splines or bars that are deformed or indented by the thread of the neck so as to form the thread indentation. The beads may extend on either side of the thread. Finally, at least one thread indentation is formed in some of the beads.

In another advantageous aspect, the skirt is continuous over its entire periphery, such that it remains in position around the neck after the rupture means have ruptured. In addition or in a variant, the skirt includes a longitudinal slot that makes it possible to remove the skirt from the neck after the rupture means have ruptured. The skirt may also remain connected to the ring via a strong sector that is advantageously situated beside the slot, such that the skirt may be removed from the neck in the form of a strip.

In a practical embodiment, the rupture means comprise breakable bridges of material that are separated by slots. It is also possible to envisage the rupture means in the form of localized reduction in the wall thickness of the ring, which localized reduction constitutes a line or zone of weakness that is suitable for being broken easily by turning the ring about the neck.

In another practical aspect, the neck includes an annular peripheral lip that is situated above the thread, the lip defining a frustoconical wall so as to make it easier to engage the skirt around the neck.

According to another characteristic, the hoop is engaged around the ring via two portions, namely a bottom portion that is situated below the rupture means and that incorporates the skirt, and a top portion that is situated above the rupture means, the friction in turning between the top portion and the hoop being greater than the friction in turning between the bottom portion and the hoop. Thus, the hoop mainly causes the top portion to turn and does not prevent the bottom portion from moving downwards, thereby breaking the rupture means.

The spirit of the present invention relies on the principle of breaking a fastener ring that is mounted on a threaded neck so as to give a clear indication that the dispenser has been opened, and simultaneously to prevent the dispenser head from being mounted once more on the reservoir. The abutment means, which are also combined with a reverse screw-thread, guarantee that the ring is broken during the first attempt to unscrew it. In addition, the axial and non-rotary mounting of the ring on the threaded neck with the creation of thread indentations makes it possible to avoid all of the drawbacks associated with screw-fastening. The hoop makes it possible to deform the skirt against the thread so as to create thread indentations, but it also makes it possible to block the skirt below the shoulder, thereby preventing the ring from being unscrewed. The user is thus constrained to screw-tighten the ring on the neck, and this certainly causes the ring to rupture.

The invention is described more fully below with reference to the accompanying drawings, which show an embodiment of the invention by way of non-limiting example.

Figure 1:
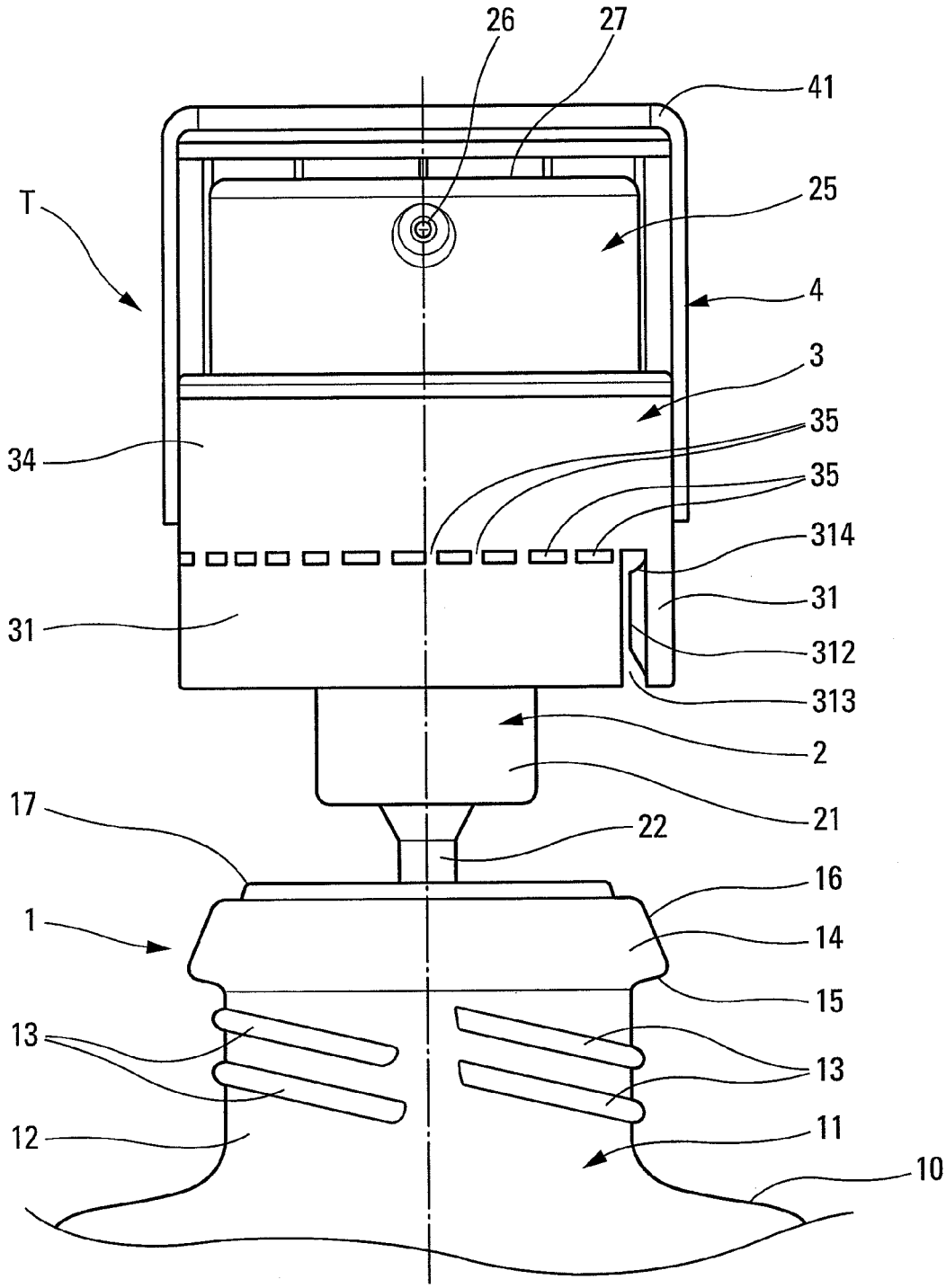
FIG. 1 is a view showing a fluid dispenser of the invention just before the dispenser head is mounted on the threaded neck of the reservoir.

The fluid dispenser shown in the figures in order to illustrate the present invention comprises two distinct parts or sub-assemblies, namely a fluid reservoir 1 and a dispenser head T for mounting on the reservoir so as to co-operate with each other to constitute the dispenser.

The fluid reservoir 1 is shown in part only in the figures. Only the neck 11 and a portion of the body 10 of the reservoir is shown in the figures. The neck 11 projects axially upwards from the body 10. Internally, the neck 11 defines an opening that puts the inside of the reservoir into communication with the outside. Externally, the neck 11 forms a constricted section 12 that is connected directly to the body 10 of the reservoir. The constricted section 12 includes a plurality of helical threads 13 that are in the form of one or more projecting ribs disposed in helical manner. The threads 13 may extend over all or part of the periphery of the neck. The threads 13 may be continuous, or, on the contrary, they may be interrupted. The purpose of the threads 12 is to enable a turning movement to be combined conventionally with an axial movement. This may be referred to as screw-tightening/unscrewing movement. However, in the invention, the threads 13 extend with an unusual slope since they rise from right to left, so that unscrewing is in the clockwise direction and screw-tightening is in the counter-clockwise direction. Consequently, a user trying to loosen the screw is actually tightening it, and vice versa. As described below, this "reverse" thread provides an advantage in the context of the present invention. In addition, axially above the constricted section 12, the neck 11 includes an annular peripheral lip 14 that projects outwards relative to the constricted section 12. The lip 14 defines an annular shoulder 15 that is directed downwards. The shoulder 15 is connected to the constricted section 12 and extends outwards so as to define the maximum diameter of the neck. Beyond its maximum diameter, the annular lip 14 forms a frustoconical wall 16 that converges upwards, i.e. towards the top end of the neck on which there is formed an annular sealing ridge 17. The function of the frustoconical wall is to make it easier to mount the dispenser head on the neck, as described below. In entirely general manner, the reservoir 1 may be made of any material that enables a neck to be obtained that is rigid and not deformable. In particular, the reservoir may be made of glass, of metal, or even of a rigid plastics material.

The dispenser head T essentially comprises three component members, namely: a dispenser member 2 that may be a pump or a valve; a pusher 25 that is mounted on the dispenser member 2 so as to actuate it; and a fastener member 3, 4 that is in engagement both with the threaded neck 11 of the reservoir and with the dispenser member 2. Reference is made below to all of the figures while describing the structure of the dispenser head.

The dispenser member 2 includes a body 21 that defines, at one of its ends, an inlet 22 for the fluid coming from the reservoir, which inlet may advantageously be provided with a dip tube 23. The body 21 forms a fastener collar (not shown) that projects radially outwards. The dispenser member 2 also includes an actuator rod (not shown) that projects upwards, out from the body, and that is axially movable down and up relative to the body. A return spring (not shown) urges the actuator rod into the position in which it is extended to its maximum out from the body. The actuator rod internally defines a flow channel for the fluid put under pressure inside the body. This design is entirely conventional for a pump or a valve in the fields of perfumery, cosmetics, or even pharmacy. Given that the internal structure of the dispenser member 2 is not critical for the present invention, it is not described in greater detail below.

The pusher 25 is mounted on the free end of the actuator rod of the dispenser member 2. The fluid coming from the actuator rod is conveyed via an internal channel to a dispenser orifice 26 formed by the pusher. In addition, the pusher includes a bearing surface 27 on which the user may press using one or more fingers so as to move the pusher axially down and up. In this way, fluid is dispensed through the dispenser orifice 26, optionally in metered manner. Here again, this design is entirely conventional for a fluid dispenser.

The fastener member comprises two distinct component elements, namely a fastener ring 3 and a blocking hoop 4. The hoop 4 is engaged around the ring 3 in such a manner as to mask all or part of it. One purpose of the hoop 4 is to deform the ring 3 radially inwards and to hold it in that state.

The ring 3 is advantageously made of a plastics material that is deformable and malleable making it possible to create both zones that deform easily, and other zones that are more rigid. The ring 3 presents an overall configuration that is substantially circularly cylindrical about the axis of the dispenser. The ring 3 is preferably made as a single piece, but it is possible to distinguish three portions, each performing a distinct function.

Figure 2:
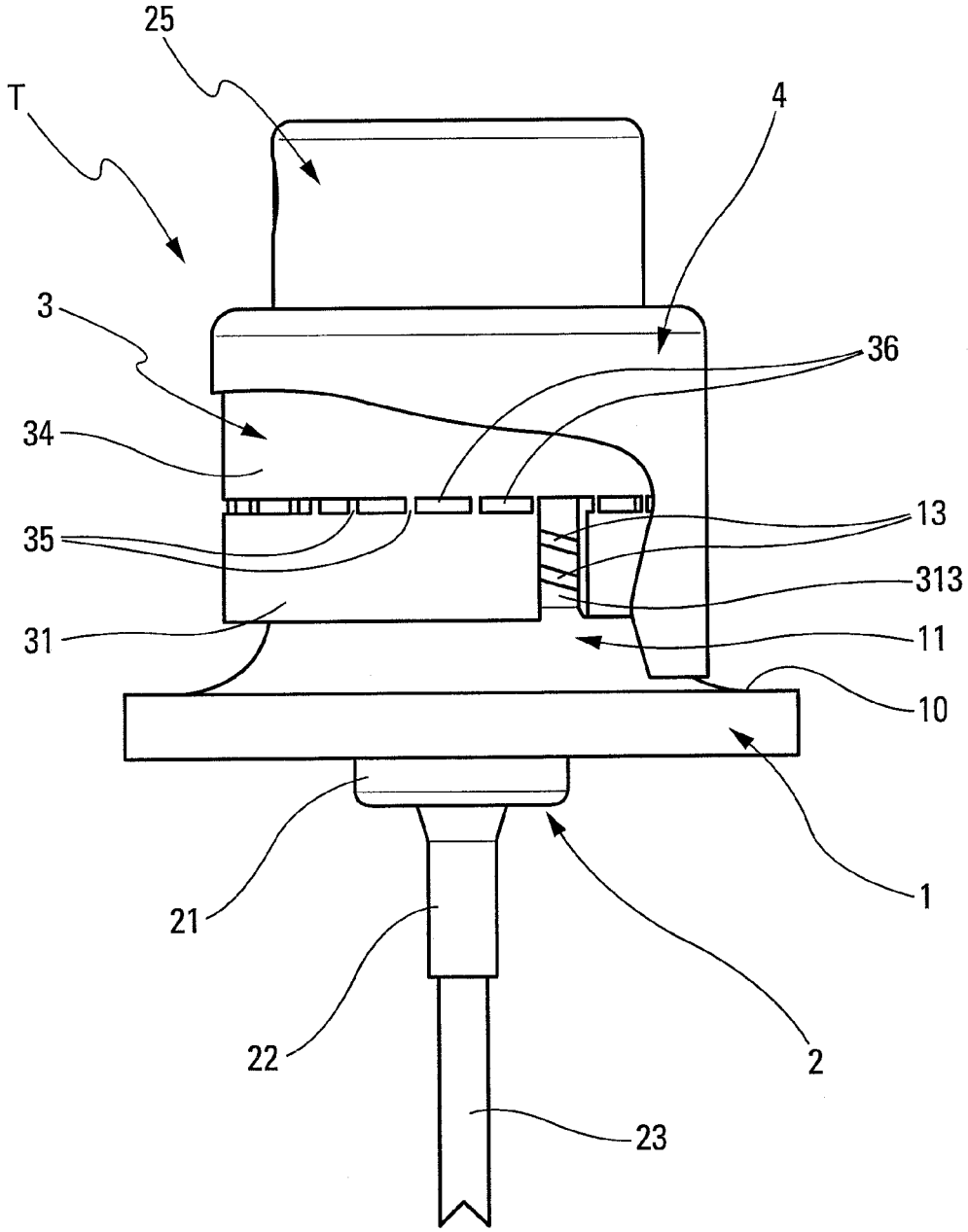
FIG. 2 is a view of the FIG. 1 fluid dispenser in its assembled state.
Figure 3:
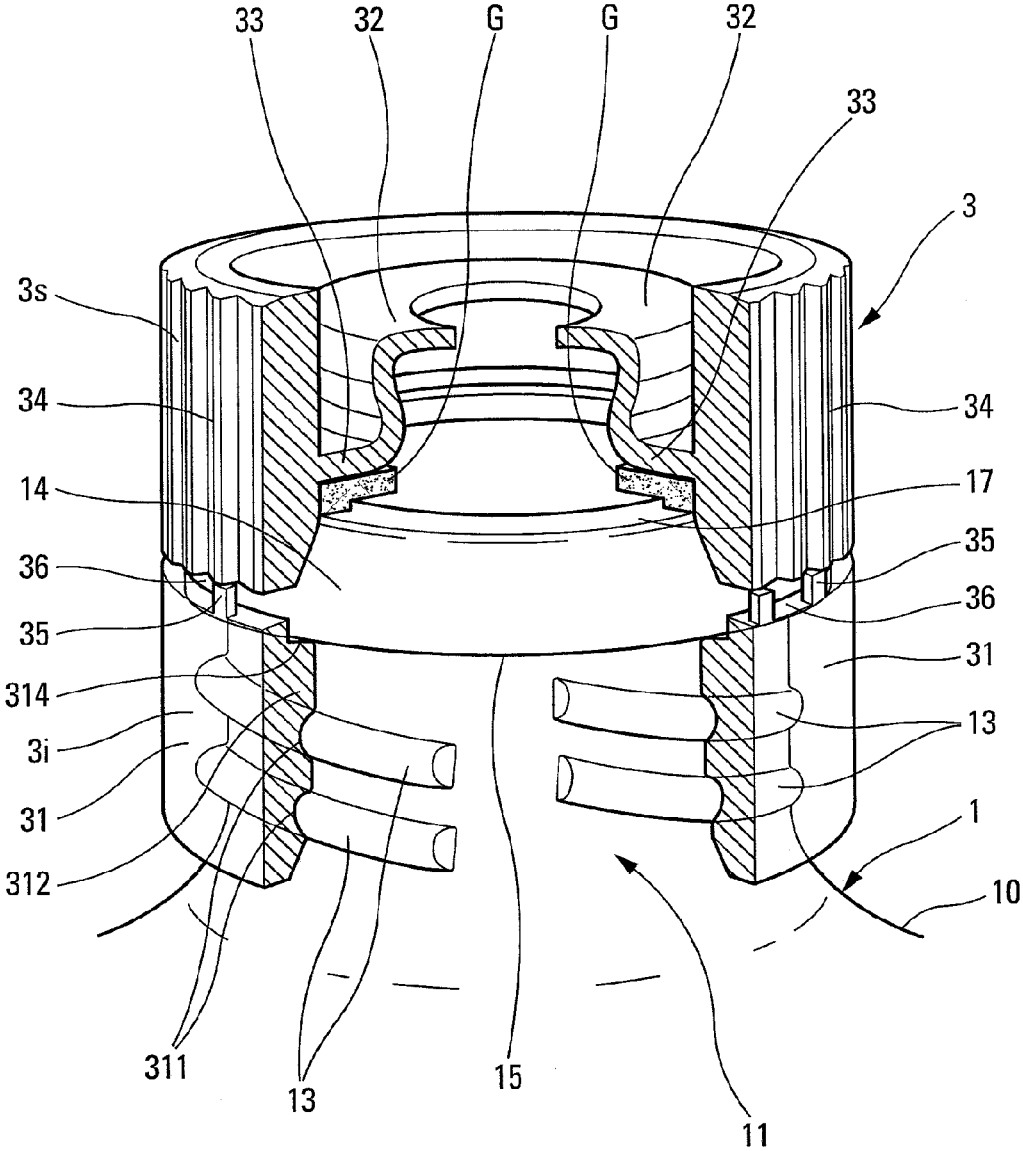
FIG. 3 is a cut-away perspective view of the fastener ring mounted on a threaded neck of the invention.

The ring 3 thus includes a skirt 31 for coming into engagement around the threaded neck 11 of the reservoir. Consequently, in the mounted position, the skirt 31 extends around the neck 11 down to below threads 13, as shown in FIGS. 2 and 3. The skirt 31 may be continuous over its entire periphery in such a manner as to form a complete cylinder. In a variant, as shown in FIGS. 1 and 2, the skirt 31 includes a radial slot 313. The slot 313 may extend over all or part of the height of the skirt 31. In other words, a portion of the skirt may remain continuous, while another portion that is lower down is slotted. As a result of the skirt 31 being made of a malleable material, it presents great flexibility, in particular in the radial direction. It may thus be deformed outwards and inwards without any risk of damaging it. The inside wall of the skirt may be completely smooth, or, on the contrary, in a variant, it forms beads 312 that project radially inwards. The beads 312 are situated in the proximity of the free bottom end of the skirt. The beads 312 are preferably thin and elongate in the axial direction. They are thus in the form of separate small vertical splines or bars. The beads 312 may present beveled leading edges so as to make it easier to put the ring into place on the neck of the reservoir. The beads 312 are disposed on the skirt 31 in such a manner as to come to be positioned on the threads 13. The beads 312 are for being plastically deformed against the threads 13 of the neck 11.

In addition to the skirt 31, the ring 3 also forms a guide and preassembly bushing 34 that extends upwards in register with the skirt 31. The bushing extends upwards relative to a ledge 33, while the skirt extends downwards relative to the ledge. In other words, the bushing is connected to the skirt near the ledge. The bushing 34 presents a configuration that is substantially cylindrical, with a diameter that is appropriate for receiving the hoop 4, as described below.

Near the junction between the bushing 34 and the skirt 31, the ring 3 forms a bearing ledge 33 that projects radially inwards. The ledge 33 is for coming to push against the ridge 17 of the neck 11, with a neck gasket G possibly being interposed between them. Thus, the thrust from the ledge causes the neck gasket G to compress, such that good sealing is thus provided between the dispenser member 2 and the neck 11. The compressed state of the gasket G is provided solely by the press used for mounting the dispenser head T, and not by the deformation of the skirt 31, as occurs with prior-art fastener members.

The ring 3 also forms a snap-fastener housing 32 that serves as reception means for receiving the dispenser member 2. More precisely, the collar (not shown) of the body 21 is snap-fastened in the housing 32. In a variant, it is possible to form the reception means in the ledge 33, without going beyond the ambit of the invention.

In the invention, the ring 3 is provided with rupture means 35, 36 that make it possible to break the ring into at least two portions so as to be able to remove the pump or the valve from the reservoir. Advantageously, the rupture means 35, 36 are provided between the ledge 33 and the skirt 31. In the present example, this means that the rupture means may be formed by the ledge, by the skirt, and/or by the junction between the ledge and the skirt. By way of example, the rupture means 35, 36 may be provided in the ledge 33. In a preferred variant, the rupture means 35, 36 are provided in the skirt 31. In an advantageous embodiment, the rupture means 35, 36 are formed approximately where the skirt is connected to the ledge. By way of example, the rupture means may be in the form of breakable bridges of material 35 that are separated by elongate slots 36 that pass through the wall thickness of the skirt. It can easily be understood that the formation of the slots 36 considerably weakens the connection between the skirt 31 and the remainder of the ring, given that the bridges 35 are weak. Instead of slots 35, it is also possible to imagine other embodiments for the rupture means. The rupture means may be made in the form of one or more grooves enabling the wall thickness of the ring to be reduced locally.

In FIG. 3, it should be observed that the bridges 35 and the slots 36 are positioned over the annular lip 14, and that the skirt 31 forms an abutment profile 314 that is received just below the shoulder 15 of the lip 14. Advantageously, the abutment profile 314 may be formed by the top ends of the beads 312. The skirt 31 is thus snap-fastened below the annular lip, and preferably it is impossible to remove it, such that the skirt is held captive by the neck. However, it is possible to envisage making the skirt with a slot 313 so as to make it easier to remove.

As shown in FIG. 3, the ring may hold on to the neck by itself, but, as shown in FIGS. 1 and 2, the ring is preferably associated with a blocking hoop 4.

The blocking hoop 4 may be a visible hoop that is attractive, or, on the contrary, it may be an internal hoop that is not visible. In the figures, the hoop 4 is a visible covering hoop that may be made of metal, for example. The hoop 4 is generally cylindrical with an inwardly-directed top rim 41 for coming to cover the free top end of the bushing 34. The inside diameter of the hoop 4 is slightly smaller than or equal to the outside diameter of the ring 3. The hoop 4 thus compresses and holds the skirt 31 of the ring in a substantially-cylindrical configuration. The hoop may even participate in deforming the skirt against the threads of the neck by pushing it hard against the threads.

Reference is made below to FIGS. 1 and 2 in order to describe a cycle for mounting a dispenser head T on a threaded reservoir-neck. In FIG. 1, the dispenser head is not yet in engagement with the neck 11. The skirt 31 thus extends in completely cylindrical manner, without being subject to any deformation. The hoop 4 is pre-engaged around the ring 3 over the bushing 34. The ring 3 and the hoop 4 thus constitute a single sub-unit that is inseparable, and that is therefore held captive. In addition, the bushing 34 makes it possible to hold and to guide the hoop accurately axially. It should be observed that the hoop 4 is not yet engaged around the skirt 31. The first mounting step consists in engaging the skirt 31 around the threaded neck 11. This operation is made easier by the frustoconical configuration of the wall 16 of the neck, which wall acts as a centering cone. The dispenser member 2 is thus engaged inside the opening of the neck. The beads 312 formed on the skirt are finally put into place on the threads 13. The next mounting step consists in lowering the hoop 4 around the ring 3. This is performed by exerting pressure on the inwardly-directed rim 41 of the hoop. This pressure makes it possible to flatten the neck gasket G so as to provide sealing. The hoop 4 thus begins to be engaged around the skirt 31. The beads 312 begin to be pressed hard against the threads 13. The operation of lowering or engaging the hoop 4 around the ring 3 continues until the hoop surrounds the ring completely, as shown in FIG. 2. This corresponds to the final mounted position in which the beads 312 are deformed against the threads 13 in such a manner as to create thread indentations 311 in the material constituting the beads 312. It is possible to determine the final mounted position as the position in which the bottom end of the hoop 4 comes into abutment contact with the body 10 of the reservoir. The deformation of the beads is plastic deformation by instantaneous and/or subsequent movement of material, in particular by creep. It is known that plastics materials tend to creep over time in order to achieve a final deformed state. In the context of the present invention, the creep phenomenon is used to advantage, given that a relatively lengthy period of time passes between the dispenser being mounted and the dispenser head being removed when the reservoir is empty.

When the user wishes to remove the dispenser head T from the reservoir, the user exerts torque on the hoop 4 with one hand, while holding the reservoir firmly with the other hand. The torque exerted on the hoop is transmitted to the ring 3, and more particularly to its skirt 31. Intuitively, the user applies torque in the counter-clockwise direction that corresponds to the conventional direction for unscrewing. But since the threads slope in the opposite direction relative to the conventional direction, in reality the user screws the skirt more tightly onto the threaded neck, thereby implying that the skirt is urged downwards towards the reservoir body. One condition is that the friction in turning between the hoop and the ring is greater than the friction in turning between the skirt and the neck. It is possible to increase the friction between the hoop and the ring by forming appropriate profiles between the hoop and the ring, e.g. at the bushing 34, or more generally at the top portion 3*s* of the ring situated above the bridges 35. In FIG. 3, it should be observed that this portion 3*s* of the ring is fluted vertically, and can co-operate with fluting formed inside the hoop 4. The bottom portion 3*i* that incorporates the skirt 31 is smooth, and offers only a small amount of friction in turning. The skirt thus turns about the neck, moves downwards, and consequently traction is exerted on the bridges 35 that finally break, irreversibly separating the skirt from the remainder of the ring. The final result is that the user breaks the ring, while believing that the dispenser head has merely been unscrewed from the reservoir. The clockwise to counter-clockwise reversal of the thread thus presents a particular advantage in the context of the present invention. But even without this thread reversal, the user wishing to unscrew the dispenser head quickly realizes that it is not possible to unscrew it: the skirt is blocked in abutment below the shoulder 15 of the lip 14. The user then automatically starts to screw-tighten the head under the impression of having begun by turning in the wrong direction. The user thus breaks the bridges 35, such that the head is thus separated from the reservoir. The abutment means are important in this configuration, but it should be kept in mind that it is possible to omit the abutment means when the threads are reversed, since the user initially seeks to unscrew the head, and it is then that the user breaks the bridges.

Either way, the user breaks the ring while trying to remove the dispenser. Finally, the skirt advantageously remains in place on the neck, blocked by the lip 14. When the skirt is entirely continuous, it remains held captive by the neck. In contrast, when it is slotted, it remains on the neck, but it can be removed very easily.

Figure 4:
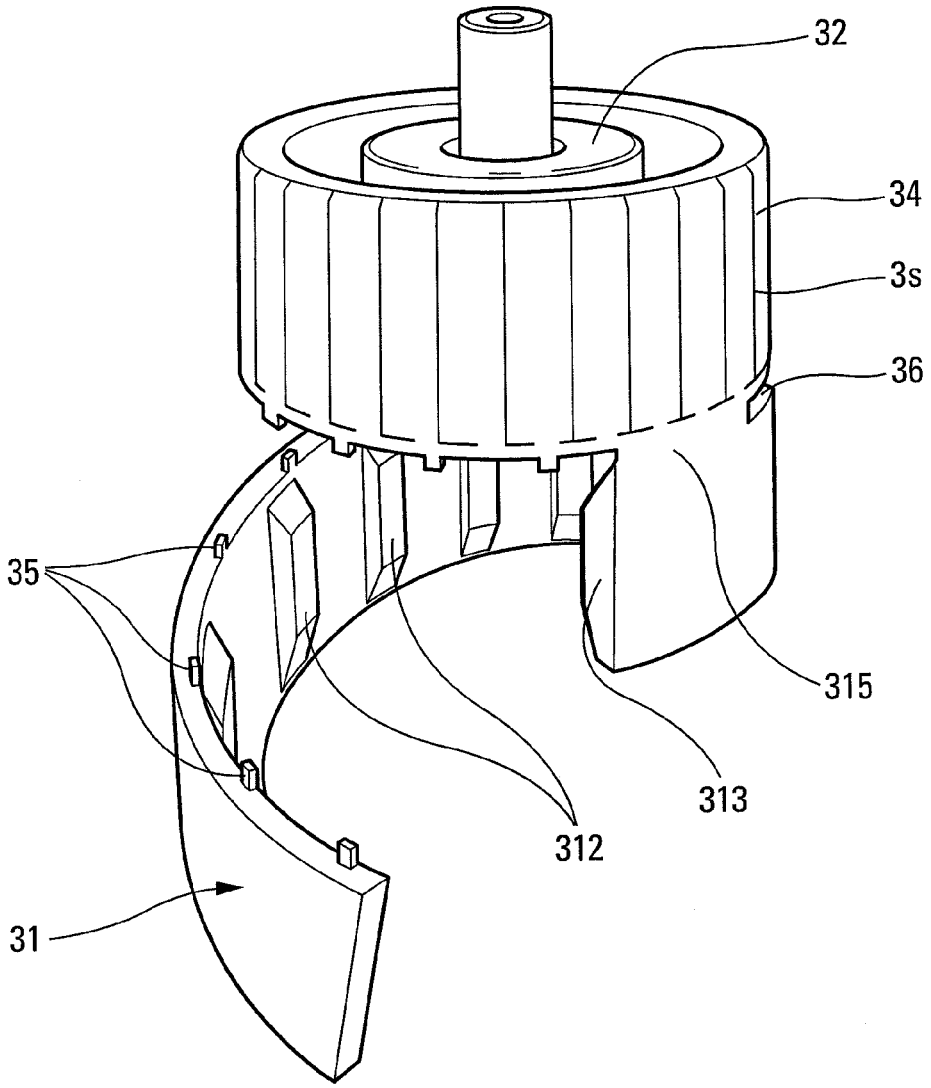
FIG. 4 is a perspective view of a fastener ring variant of the invention.

In a variant shown in FIG. 4, the rupture means 35, 36 extend over a fraction only of the periphery of the skirt so that once the rupture means have been broken, the skirt remains secured to the remainder of the ring via a strong sector 315 of the skirt. The sector 315 that remains connected to the remainder of the ring represents less than one half, and preferably less than one fourth, of the total periphery of the skirt. Advantageously, the sector 315 is situated adjacent to the slot 313 so that after the bridges 35 have ruptured, the skirt 31 is in the form of a strip having one end that is free and its other end that is connected to the remainder of the ring via the sector 315. This can be seen clearly in FIG. 4. Thus, the ring may be broken and the dispenser head may be removed from the threaded neck with the skirt that remains secured to the ring. As a result, this avoids any subsequent operation of removing the skirt from the neck of the reservoir, together with any risk of losing the skirt.

Without going beyond the ambit of the invention, it is possible to make the skirt without beads (with a smooth inside wall), and/or without slots (with a rupture groove), the neck without a lip, and/or with counter-clockwise threads, the neck with clockwise threads and/or with a lip, the fastener member without blocking hoop (merely a ring), and/or abutment means elsewhere on the neck (threads, constricted section, body). It is only necessary for the neck to be threaded and for the ring to include rupture means. It is the combination of these two characteristics that defines the present invention.

Thus, by means of the invention, it is possible to fasten a dispenser head on a reservoir with a threaded neck, advantageously without performing a screw-tightening operation, while making it possible to remove the head permanently, while breaking the fastener ring in an attempt to unscrew it.

The invention claimed is:

1. A fluid dispenser comprising:

a fluid reservoir provided with a neck that is externally threaded and that internally defines an opening that communicates with the inside of the reservoir, the neck forming at least one helical thread; and a dispenser head (T) that is mounted on the neck of the reservoir, the head (T) comprising: a dispenser member; a pusher for actuating the dispenser member; and a fastener member that is in engagement both with the threaded neck of the reservoir and with the dispenser member;

the fastener member including a ring, the ring forming: reception means for securely receiving the dispenser member; an annular ledge for exerting pressure on the neck; and a skirt that is suitable for coming into engagement with the threaded neck;

wherein the ring includes rupture means between the ledge and the skirt so as to separate the ledge from the skirt by turning the ring on the threaded neck, in such a manner as to make possible removal of the dispenser member from the reservoir;

the dispenser further comprises abutment means preventing the skirt from being unscrewed from the threaded neck;

the neck comprises an annular peripheral lip situated above the thread, the lip defining the abutment means in the form of an annular shoulder below which the skirt comes into abutment when attempting to unscrew the skirt from the neck;

the skirt is malleable in such a manner as to deform on the threaded neck;

the fastener member further comprises a rigid hoop that is engaged around the skirt so as to push the skirt radially against the threaded neck in such a manner as to deform the skirt against the thread of the neck and create a thread indentation in the skirt and to lock the skirt under the annular shoulder; and wherein once the ring with the skirt is removed, the ring with the skirt is no longer screwable on the threaded neck.

2. A dispenser according to claim 1, wherein the thread of the neck slopes upwards from right to left, such that the screw-tightening direction is counter-clockwise and the unscrewing direction is clockwise.

3. A dispenser according to claim 1, wherein the skirt is internally provided with a plurality of beads for being deformed by the thread of the neck, so as to create a thread indentation.

4. A dispenser according to claim 1, wherein the skirt is continuous over its entire periphery, such that it remains in position around the neck after the rupture means have ruptured.

5. A dispenser according to claim 1, wherein the skirt includes a longitudinal slot that makes it possible to remove the skirt from the neck after the rupture means have ruptured.

6. A dispenser according to claim 5, wherein the rupture means extend over a fraction only of the periphery of the skirt so that once the rupture means have broken, the skirt remains secured to the remainder of the ring via a strong sector, the sector advantageously being situated adjacent to the slot.

7. A dispenser according to claim 1, wherein the rupture means are formed at the skirt.

8. A dispenser according to claim 1, wherein the rupture means comprise breakable bridges of material that are separated by slots.

9. A dispenser according to claim 1, wherein the neck includes an annular peripheral lip that is situated above the thread, the lip defining a frustoconical wall so as to make it easier to engage the skirt on the neck.

10. A dispenser according to claim 1, wherein the hoop is engaged around the ring via two portions, namely a bottom portion (3*i*) that is situated below the rupture means and that incorporates the skirt, and a top portion (3*s*) that is situated above the rupture means, the friction in turning between the top portion (3*s*) and the hoop being greater than the friction in turning between the bottom portion (3*i*) and the hoop.

11. The dispenser according to claim 1, wherein the dispenser member is a pump or a valve.

12. The dispenser according to claim 1, wherein the skirt has a part engaged with the at least one helical thread and the rupture means is located between the ledge and the part.

13. A fluid dispenser comprising:

a fluid reservoir provided with a neck that is externally threaded and that internally defines an opening that communicates with an inside of the reservoir, the neck forming at least one helical thread defined by a projecting helical rib having a helical top surface portion and a parallel helical bottom surface portion; and a dispenser head that is mounted on the neck of the reservoir, the head comprising a dispenser member; a pusher for actuating the dispenser member; and a fastener member that is in engagement both with the threaded neck of the reservoir and with the dispenser member;

the fastener member comprising a ring, the ring forming an opening having a support for the dispenser member, the support extending radially inward; and a skirt configured to be in threaded engagement with the at least one helical thread;

wherein the ring includes a weakened portion configured to rupture and separate a lower portion of the ring from an upper portion of the ring so as to separate the support from the skirt by turning the ring on the threaded neck and so as to allow removal of the dispenser member from the reservoir the neck comprises an annular peripheral lip disposed above the thread, the lip defining an annular shoulder below which the skirt comes into abutment preventing the skirt from being unscrewed from the threaded neck;

the skirt is malleable in such a manner as to deform on the threaded neck;

the fastener member further comprises a rigid hoop engaged around the skirt so as to push the skirt radially against the threaded neck in such a manner as to deform the skirt against the thread of the neck and create a thread indentation in the skirt and to lock the skirt under the annular shoulder; and wherein, once the weakened portion is ruptured and the ring with the skirt is removed, the ring with the skirt is no longer configured to be screwed on the threaded neck.

14. The dispenser according to claim 13, wherein the lower portion of the ring engages with the at least one helical thread and the weakened portion is located between the lower portion and the support.

15. The dispenser according to claim 13, wherein the weakened portion is formed by breakable bridges.

* * * * *